United States Patent [19]

Hoffman

[11] 4,010,999

[45] Mar. 8, 1977

[54] DEAD-FRONT ELECTRICAL PLUG

[75] Inventor: Ernest Gerhard Hoffman, Middlefield, Conn.

[73] Assignee: Harvey Hubbell Incorporated, Orange, Conn.

[22] Filed: Sept. 2, 1975

[21] Appl. No.: 609,797

[52] U.S. Cl. ..... 339/107; 339/128; 339/210 M

[51] Int. Cl.[2] ..... H01R 13/58

[58] Field of Search ..... 339/59 M, 75 MP, 107, 339/91 R, 128, 131, 176 MP, 210 M

[56] References Cited

UNITED STATES PATENTS 3,784,961 1/1974 Gartland, Jr. ..... 339/107

FOREIGN PATENTS OR APPLICATIONS 676,144 7/1952 United Kingdom

*Primary Examiner*—Roy Lake
*Assistant Examiner*—DeWalden W. Jones
*Attorney, Agent, or Firm*—Jerry M. Presson

[57] ABSTRACT

A one-piece dead-front electrical plug comprises a dead-front member, conductive blades mounted therethrough, and two side covers hingedly connected to the dead-front member by integral web hinges. The side covers pivot between an open position affording access for making wiring connections between a cord and the conductive blades, and a closed position fully enclosing the wiring area. Each side cover has cord clamp teeth which cooperate to grip the cord. The web hinges are protected from longitudinal stress in one embodiment by side cover flanges which are matingly received in notch openings in the dead front member, and in another embodiment by dowel pins protruding from the dead-front member which are matingly received in openings in the side covers. Lateral stress protection of the web hinges is provided by an interengaging flange and groove structure of the side covers and dead-front member. A sealing compound barrier sleeve fits around the wiring connections and tightly against the dead-front member, and is filled with sealing compound to moisture-proof the wiring connections.

21 Claims, 10 Drawing Figures

101
174
160
176
167
124
120
122
128
125
140
145
154
156
146
143
144
172
132
130
158
178
141
170
171
161
127
131
150
179
159
151
166
126
133
173
175
163
177
165
168
129
111
123
135
136
110
148
157
153
155
121

180
100
107
106
136
156
151
153
150
133
135
131
161
175
111
108
121
110
141
152
103
104

180
181
183
182
184

113
109
100
160
186
116
187
115
114
106
105
124
103
102
104

DEAD-FRONT ELECTRICAL PLUG

BACKGROUND OF THE INVENTION

This invention relates to a one-piece dead-front electrical plug connector, and more particularly to a one-piece dead-front electrical plug connector of high strength which is inexpensive to manufacture and extremely safe in use.

Electrical plug connectors fall into two broad categories, which are electrical plug connectors of the live-front type and electrical plug connectors of the dead-front type. In the live-front type, access to terminal screws for securing wire conductors to the blades of the plug is provided through the face or front of the electrical plug connector. The front of the electrical plug connector is usually covered by a removable insulating disc after the wire connections have been made. The live-front type of electrical plug connectors is characterized by few parts, and accordingly is simple and inexpensive to produce. However, a high level of care in wiring and maintenance is required to provide safe and trouble-free service. In particular, the insulating disc utilized to cover the front of the electrical plug connector and thereby shield the exposed terminal screws and connected wire conductors often becomes loose or is lost from the electrical plug connector.

In electrical plug connectors of the dead-front type, the blades extend through a heavy insulating face or front of the plug, and access to the terminal screws is provided behind the front of the plug. The wiring area, in which wire conductors of a cord are secured to the terminal screws is usually fully enclosed by a cover after wiring is accomplished. Electrical plug connectors of the dead-front type can accommodate greater variations in the quality of wiring and maintenance without loss of safety or service. However, electrical plug connectors of the dead-front type generally comprise more parts and are more costly to produce than electrical plug connectors of the live-front type. Therefore, they have not come into the wide-spread use and acceptance which the greater safety factor associated therewith would seem to dictate.

SUMMARY OF THE INVENTION

The invention provides a one-piece dead-front electrical plug connector including a dead-front portion and side covers hingedly connected thereto by webs. Power blades and a ground pin, if desired, are mounted through the dead front portion of the plug, and an integral upstanding insulation barrier separates the wiring terminals of the power blades and ground pin. A cord comprising a plurality of wire conductors is wired to the electrical plug connector with its side covers in their open positions, which provides ready access to the wiring terminals. A barrier is optionally fitted about the wiring terminals and confines a sealing compound for moisture proofing the wiring connections.

The integral side covers of the dead-front electrical plug pivot together and grip the cord connected to the wiring terminal by means of cooperating opposed cord clamp teeth integrally formed in each of the side covers. Additionally, the side covers comprise a plurality of flanges matingly received in grooves and pins matingly received in openings, all of which cooperatively interengage when the side covers are pivoted to their closed positions to provide a high strength assembled dead-front electrical plug connector.

OBJECTS OF THE INVENTION

Accordingly, it is a principal object of this invention to provide a high strength, one-piece dead-front electrical plug connector.

It is an additional object of the invention to provide a one-piece dead-front electrical plug connector with a fully insulated exterior.

It is another object of the invention to provide a dead-front electrical plug connector which affords great ease of wiring and assembly, and efficient strain-relieving cord retention.

It is a further object of the invention to provide a fully moisture-proof dead-front electrical plug connector.

It is another object of this invention to provide a dead-front electrical plug connector with the low cost advantages of a live-front plug.

Other objects of the invention will in part be obvious and will in part become apparent from a perusal of the following description of the preferred embodiments and claims, taken together with the drawings.

DRAWINGS

The same reference numerals refer to the same elements throughout the various Figures.

DESCRIPTION OF PREFERRED EMBODIMENTS

Figure 1:
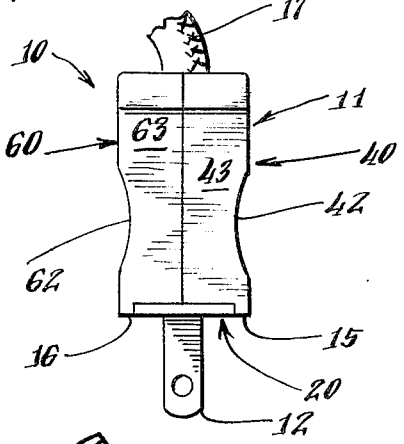
FIG. 1 is an end view of an electrical plug connector according to the invention herein.

In FIGS. 1 – 6 there is shown a one-piece dead-front electrical plug 10 of high strength, according to the invention herein. The dead-front electrical plug 10 comprises generally a plug body 11 and two power blades 12 and 13, and is adapted to make electrical connection between a cord 17 and a standard electrical socket outlet, not shown. The plug body 11 is generally comprised of a dead-front member 20 through which power blades 12 and 13 are mounted, and two side covers 40 and 60. The side covers 40 and 60 are hingedly connected to the dead-front member 20 by web hinges 15 and 16, and the entire plug body 11 is formed integrally of a high strength insulating material, such as nylon.

Referring now to FIGS. 3 – 6 in which the details of the structure of the dead-front electrical plug 10 are shown, the dead-front member 20 is comprised of a rectangular bottom plate 21 which forms a smooth base or front of the plug except for two elongated notch openings 22 and 23 located midway along the side edges of the bottom plate 21 adjacent to side covers 40 and 60, respectively. An upstanding flange 24 is provided about the rectangular periphery of the bottom plate 21. Two additional upstanding flanges 25 and 26 together with the peripheral flange 24 define two elongated grooves 27 and 28 which are parallel to the end edges of the bottom plate 21.

A block 30 is integrally formed with and upstands from the central inner area of the bottom plate 21, and a rectangular groove 31 is defined surrounding the sides of the block 30 between it and the flanges 24 – 26. The block 30 serves as a mounting and support member for the power blades 12 and 13, which are press fit into openings extending through the block 30 and the bottom plate 21 integral therewith. The upper terminal ends of the power blades 12 and 13 are provided with terminal screws 18 and 19 which are readily accessible when the dead-front electrical plug is in the open condition shown in FIGS. 5 and 6 for facilitating wire connections with wire conductors 32 and 33 of cord 17. An "H" shaped insulation barrier 34 is formed integrally with and upstanding from the block 30, and is positioned between the upper terminal ends of power blades 12 and 13.

Figure 4:
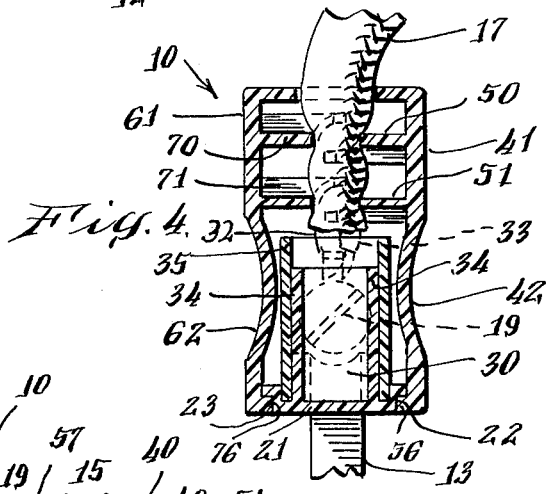
FIG. 4 is a sectional view of the electrical plug connector of FIG. 1 taken along the lines 4—4 of FIG. 2.
Figure 5:
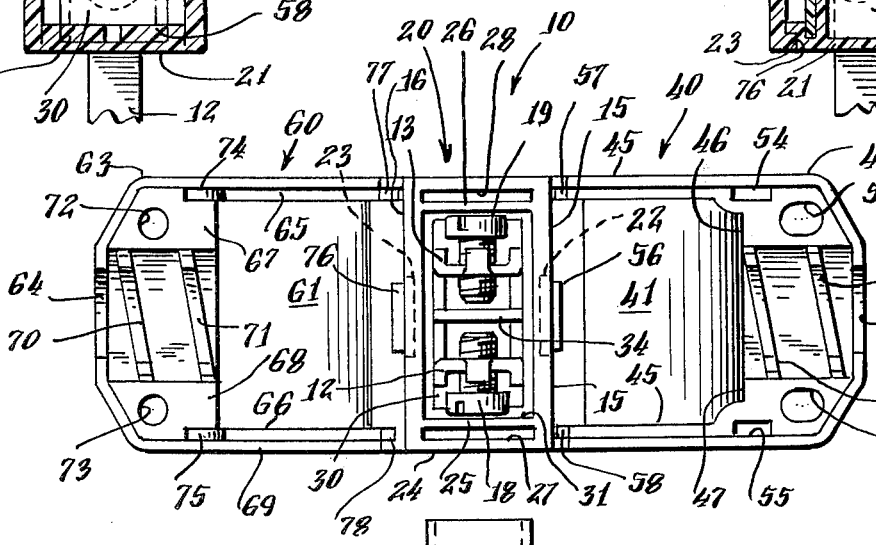
FIG. 5 is a top view of the electrical plug connector of FIG. 1 in its open condition.

Referring particularly to FIGS. 4 and 5, it will be noted that the rectangular groove 31 defined between the block 30 and the flanges 24 – 26 is adapted to receive the lower end of an optional rectangular sealing compound barrier sleeve 35. The sealing compound barrier sleeve 35 surrounds the upper ends of the power blades 12 and 13, their associated terminal screws 18 and 19, and any uninsulated or stripped portion of the wire conductors 32 and 33 adjacent to their connection to the terminal screws. The sealing compound barrier sleeve 35 is filled with a sealing or potting compound (not shown) which cures to provide a protective, fully moisture-proof wiring connection between the wire conductors and the power blades. Of course, the sealing compound barrier sleeve 35 and sealing compound may be omitted and are not necessary to the structure of the dead-front electrical plug 10, although they do provide additional safety and service features and are accordingly preferred.

Figure 6:
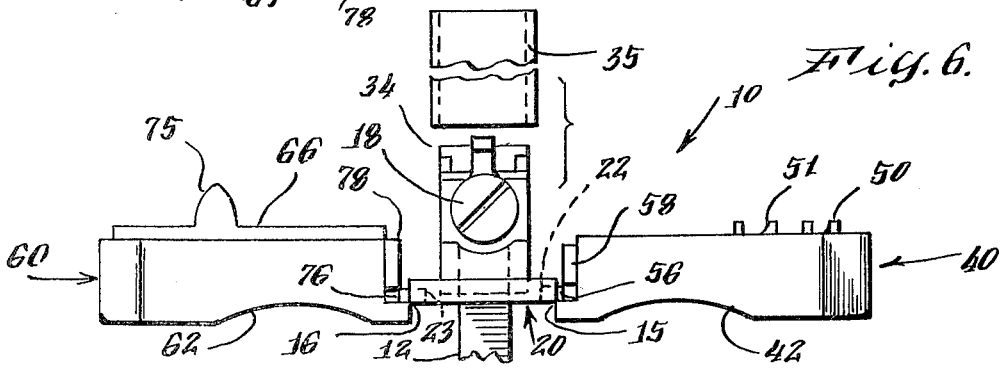
FIG. 6 is an end view of the electrical plug connector of FIG. 1 in its open condition.
Figure 7:
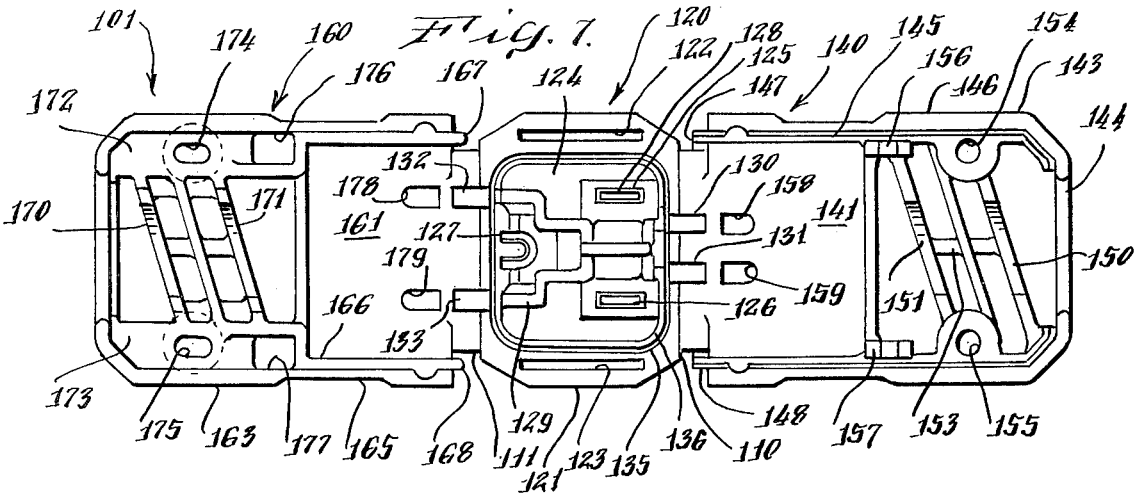
FIG. 7 is a top view of another electrical plug connector according to the invention herein in its open condition.

The plug body 11 of the dead-front electrical plug 10 further comprises side covers 40 and 60 which are integrally connected to the dead-front member 20 by means of web hinges 15 and 16, respectively. As best seen in FIGS. 5 and 6, web hinges 15 and 16 each comprise two thin, aligned, flexible webs which flank the notches 22 and 23 in the bottom plate 21 of the dead-front member 20 and extend between the bottom plate 21 and the side covers 40 and 60, wherein the side covers are pivotally mounted with respect to the dead-front member 20.

Figure 2:
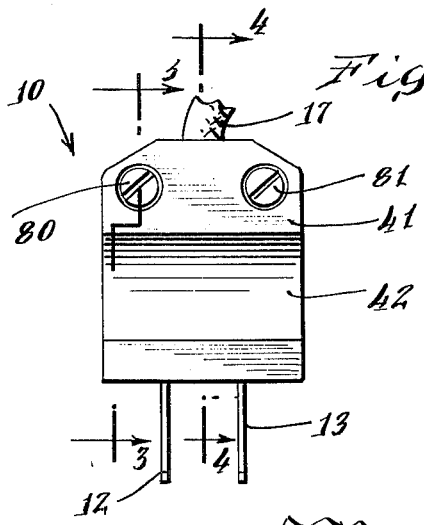
FIG. 2 is a front view of the electrical plug connector of FIG. 1.

The side cover 40 comprises a front panel 41, which, as viewed in FIG. 2, comprises the front of the dead-front electrical plug 10. A concave portion 42 of the front panel 41 cooperates with a similar concave portion 62 on panel 61 of side cover 60, which comprises the back of the electrical dead-front plug 10, as viewed in FIG. 2, to facilitate gripping the assembled plug for inserting it into and removing it from electrical socket outlets.

The side cover 40 further comprises a wall 43 which is generally perpendicular to and extends around three sides of the front panel 41. The wall 43 forms substantially one-half of the ends and top of the assembled dead-front electrical plug 10, as best seen in FIG. 1. In the portion of wall 43 which forms the top of the assembled dead-front electrical plug 10 there is defined a semi-circular opening 44 which accommodates the passage of cord 17.

The wall 43 further includes a shoulder 45 which extends about the inner periphery thereof except at the semi-circular opening 44. The shoulder 45 is partially defined by two blocks 46 and 47 which are also integral with the front panel 41. Two cord clamp teeth 50 and 51 upstand from the inner surface of front panel 41 and are integral with and diagonally disposed between the two blocks 46 and 47. The upper surfaces of the cord clamp teeth 50 and 51 are concave.

Figure 3:
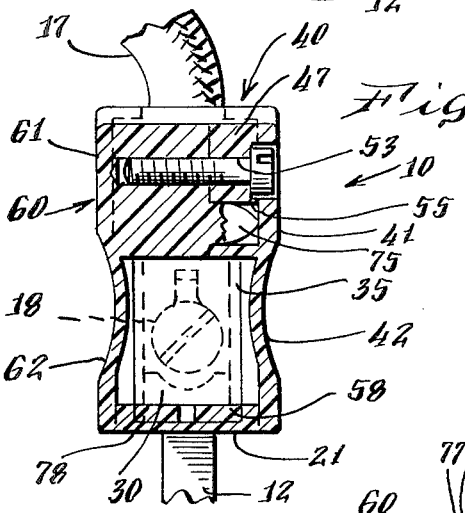
FIG. 3 is a sectional view of the electrical plug connector of FIG. 1 taken along the lines 3—3 of FIG. 2.

Two oblong openings 52 and 53 are formed through the blocks 46 and 47, respectively, and front panel 41 integral therewith, flanking the cord clamp teeth 50 and 51. The openings 52 and 53 are preferably countersunk adjacent to the front panel 41, as best seen in FIG. 3. Two additional rectangular openings 54 and 55 are formed partially through blocks 46 and 47, respectively, from the shoulder 45 of side wall 43.

The side cover 40 further comprises a rectangular flange 56 upstanding from the inner surface of front panel 41 between the two webs comprising the web hinge 15, and flange 56 is matingly received in the notch 22 formed in the dead-front member 20 when the dead-front electrical plug 10 is in its fully assembled condition, as best seen in FIG. 4. Two additional flanges 57 and 58 extend from the ends of wall 43, and are received in the grooves 27 and 28 of the dead-front member 20 when the dead-front electrical plug 10 is in its assembled condition, as best seen in FIG. 3.

As noted above, the side cover 60 is comprised of a back panel 61 having a concave portion 62. The side cover 60 is integrally hingedly connected to the dead-front member 20 by means of web hinge 16. A wall 63 upstands generally perpendicularly to the back panel 61 and extends around three sides thereof, and the wall 63 is shaped to cooperate with wall 43 of side cover 40 to form the ends and top of the assembled dead-front electrical plug 10. A semi-circular opening 64 is defined by the wall 63 opposite the opening 44 in wall 43 such that the two openings 44 and 64 together accommodate passage of the cord 17. Integral with the wall 63 along the inside edge thereof are two flanges 65 and 66 and two blocks 67 and 68. A shoulder 69 is formed along the outside of wall 63 adjacent to the flanges 65 and 66 and the blocks 67 and 68.

Two cord clamp teeth 70 and 71 upstand from the back panel 61 and are integral with and extend diagonally between the blocks 67 and 68. The upper surfaces of the cord clamp teeth 70 and 71 are concave, and it will be noted that the diagonal orientation of the cord clamp teeth 70 and 71 is opposite to that of cord clamp teeth 50 and 51 of side cover 40 such that the two sets of cord clamp teeth crisscross when the dead-front electrical plug 10 is in its assembled condition.

Two openings 72 and 73 are formed partially through the blocks 67 and 68, respectively, flanking the cord clamp teeth 70 and 71. Protruding upwardly from the flanges 65 and 66, respectively, are two prongs 74 and 75. Side cover 60 further comprises a flange 76 upstanding from the interior surface of the back panel 71 between the webs of web hinge 16 and juxtaposed the notch 23 in the dead-front member 20, and flange 76 is matingly received in notch 23 when the electrical dead-front plug 10 is in its assembled condition. Two additional flanges 77 and 78 are provided at the terminal ends of wall 63 and are received in grooves 26 and 27, respectively, as best seen in FIG. 3.

The dead-front electrical plug 10 is assembled by first stripping and connecting the ends of the two wire conductors 32 and 33 of cord 17 to the upper ends of the power blades 12 and 13 via terminal screws 18 and 19. The sealing compound barrier sleeve 35 and sealing compound, if desired, are then placed over the wire connections. After wiring has been completed, the side covers 40 and 60 are pivoted together so that the electrical dead-front plug 10 is in the assembled condition illustrated in FIGS. 1 – 4. The flanges 65 and 66 of side cover 60 butt against the shoulder 45 of side cover 40 and lie inside the wall 43 thereof. Similarly, the upper portion of wall 43 fits tightly against shoulder 69. This overlapping engagement between side covers 40 and 60 provides for a dust free interior of the dead-front electrical plug 10 and makes it resistant to the insertion of foreign objects.

Top surfaces of blocks 46 and 47 butt against the top surfaces of blocks 71 and 72. The prongs 74 and 75 of side cover 60 are received in the openings 54 and 55 of side cover 40, and the interengagement therebetween keeps the side covers 40 and 60 in alignment as the cord clamp teeth 50, 51, 70 and 71 grip the cord 17, as best seen in FIG. 4, and thereby relieve any strain on the wiring connections. The through openings 52 and 53 formed in side cover 40 align with the partial openings 72 and 73 in blocks 67 and 68 formed in side cover 60, and two self-threading screws 80 and 81 are threaded into the openings to secure the side covers 40 and 60 together.

As noted above, the flanges 56 and 76 are respectively matingly received in the notches 22 and 23 of the dead-front member 20, and the resultant interengagement provides longitudinal strength between the side covers 40 and 60 and the dead-front member 20 of the plug 10. Thus, the cooperation of flanges 56 and 76 and notches 22 and 23 relieves any longitudinal stress which would otherwise be placed on the web hinges 15 and 16 when the side covers are gripped to remove the dead-front electrical plug from an electrical socket outlet. Similarly, the flanges 57 and 77 are received in the groove 28 in the dead-front member 20 and the flanges 58 and 78 are received in the groove 25 of the dead-front member 20 (as best seen in FIG. 3) to relieve any lateral stress extant between the side covers 40 and 60 and the dead-front member 20.

During assembly of the dead-front electrical plug 10, it may be desirable to add a rubber grommet (not shown) around the cord 17 between the semi-circular openings 44 and 64, and such grommet may be used alone or in addition to the sealing compound barrier sleeve 35 and sealing compound.

Thus, the dead-front electrical plug 10 achieves the safety advantages of dead-front type electrical plugs and yet is extremely easy to wire, is extremely strong in its assembled condition, and is dust-proof and moisture-proof.

Referring now to FIG. 7 – 10, there is shown a second embodiment 100 of a dead-front electrical plug according to the invention herein. It generally comprises a plug body 101, shown alone in FIG. 7, two power blades 102 and 103, and a ground pin 104. The dead-front electrical plug 100 is adapted to make electrical connection between a cord 113 comprising three wire conductors 114 – 116 and a grounded electrical socket outlet, not shown. The plug body 101 of the dead-front electrical plug 100 is generally comprised of a dead-front member 120 and two side covers 140 and 160 which are hingedly connected thereto by web hinges 110 and 111. The entire plug body 101 is integrally formed of an insulating material, which may be nylon.

The dead-front member 120 of the plug body 101 comprises a base plate 121, the outer surface of which forms a smooth insulating face or front of the dead-front electrical plug 100. Two parallel grooves 122 and 123 are formed partially through the base plate 121 adjacent the end edges thereof. A thicker central portion 124 of the dead-front member 120 is formed integrally with the base plate 121 thereof and serves as a supporting and mounting block for the power blades 102 and 103 and the ground pin 104. To this end two rectangular openings 125 and 126 and a U-shaped opening 127 are formed through the central portion 124 and integral base plate 121 to receive the power blades 102 and 103 and the ground pin 104, respectively. Each of the openings 125 – 127 is preferably provided with a sealing lip, e.g. sealing lip 128 of opening 125, which extends laterally into the opening adjacent the bottom surface of the base plate 121.

Figure 8:
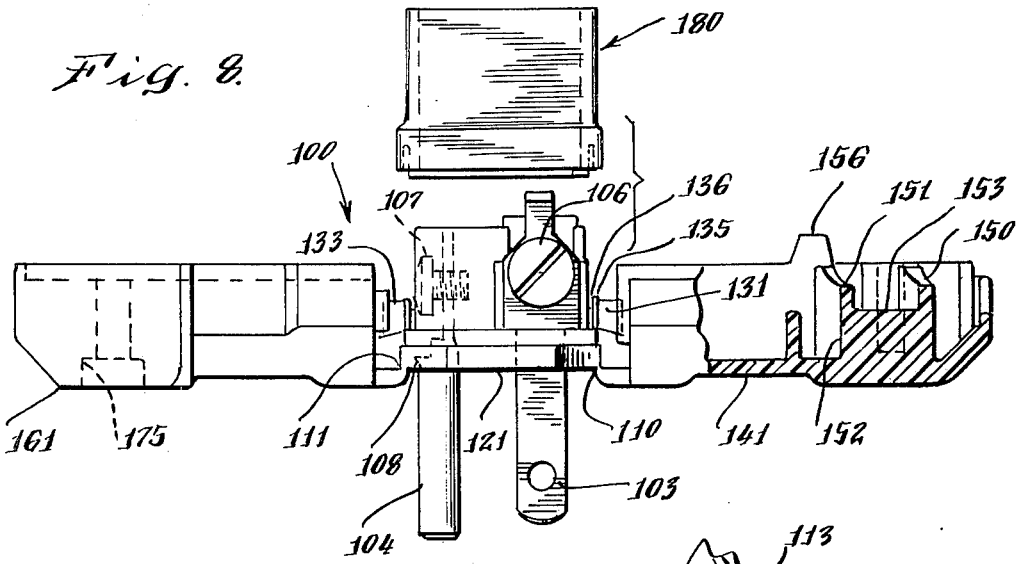
FIG. 8 is an end view of the electrical plug connector of FIG. 7 in its open position.

The power blades 102 and 103 and the ground pin 104 are pushed through the openings 125 – 127 and are retained therein by integral barbs, such as barb 108 of ground pin 104, best seen in FIG. 8. The upper ends of the power blades 102 and 103 and the ground pin 104 are provided with terminal screws 105 – 107, respectively, for making wiring connections with the three wire conductors 114 – 116 of cord 113. An insulation barrier 129 is integral with and upstanding from the central portion 124 of the dead-front member 120 and serves to isolate the power blades 102 and 103, the ground pin 104, and their associated terminal screws and any adjacent uninsulated portion of the wire conductors from each other.

Two dowel pins 130 and 131 protrude laterally from one side of the dead-front member 120. More particularly, the dowel pins 130 and 131 are positioned between the power blades 102 and 103, and are integral with the top of the thick central portion 124 and the insulation barrier 129 of the dead-front member 120. Two additional dowel pins 132 and 133 protrude laterally from the opposite side edge of the dead-front member 120, and dowel pins 132 and 133 are also integral with the thick central portion 124 and the insulation barrier 129. The dowel pins 132 and 133 flank the upper end of the ground pin 104 and its associated terminal screw 107. The dead-front member 120 further comprises a circumferential flange 135 and an associated groove 136 formed between it and the thick central portion 124. The flange 135 and groove 136 extend about the periphery of the thick central portion 124, and are elevated to pass over the dowel pins 130 – 133.

The side cover 140 comprises a panel 141, which forms the back of the assembled dead-front electric plug 100 as viewed in FIG. 4. Web hinge 110 comprises a thin web of the plug material which is integral with both the back panel 141 and the dead-front member 120, and thereby hingedly connects it with the side cover 140.

A U-shaped wall 143 upstands generally perpendicularly from the periphery of back panel 141 around three sides thereof to form substantially one-half of the top and ends of the assembled dead-front electrical plug 100. The wall 143 defines a semi-circular opening 144 which accommodates the passage of cord 113 and a surrounding sealing grommet 109. The upper edge of the wall 143 includes a flange 145 along the inside thereof, and a shoulder 146 is defined adjacent to the flange 145 along the outside of wall 143. The flange 145 is contiguous with two additional flanges 147 and 148 which protrude laterally from the ends of wall 143 as viewed in FIGS. 7 and 8, in alignment with the grooves 122 and 123, respectively, of the dead-front member 120.

Two parallel cord clamp teeth 150 and 151 are diagonally disposed between the legs of U-shaped wall 143 adjacent to the semi-circular opening 144. The cord clamp teeth 150 and 151 are integral with a thickened portion 152 of the back panel 141, and strengthening ribs 153 may also be provided in connection with the cord clamp teeth. Two openings 154 and 155 are formed partially through the side cover 140 in thickened surrounding portions of the wall 143, flanking the cord clamp teeth 150 and 151. Two prongs 156 and 157 are formed extending upwardly from the opposite legs of the U-shaped wall 143.

Figure 9:
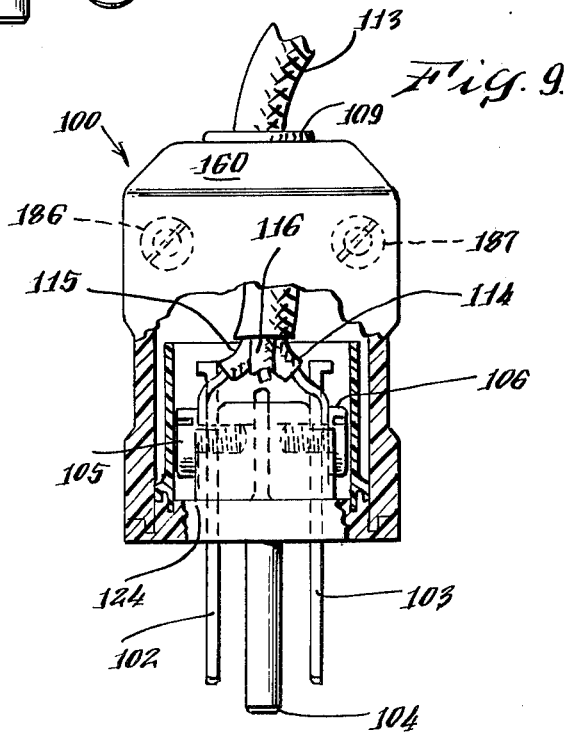
FIG. 9 is a front view, partially cut away, of the electrical plug connector of FIG. 7 in its closed position.

The back panel 141 of side cover 140 is provided with two openings 158 and 159 which matingly receive the dowel pins 130 and 131 when the dead-front electrical plug 100 is in its assembled condition shown in FIG. 9.

Side cover 160 is similar to side cover 140, and comprises a panel 161 which forms the front of the assembled dead-front electrical plug as viewed in FIG. 9. The side cover 160 is hingedly connected to the dead-front member 120 by means of web hinge 111. An upstanding U-shaped wall 163 extends around three sides of the back panel 160, and the wall 163 forms substantially the other half of the top and ends of the assembled dead-front electrical plug 100. The wall 163 defines a semi-circular opening 164 which cooperates with the opening 144 in wall 143 to accommodate passage of the cord 113 and its associated grommet 109. The upper edge of wall 163 terminates in a flange 165 and a shoulder 166, the flange 165 being disposed on the outside of the wall 143 and the shoulder 166 being located on the inside immediately adjacent thereto. Two additional flanges 167 and 168 protrude laterally from the ends of the U-shaped wall 163 as viewed in FIGS. 7 and 8, and are in alignment with the grooves 122 and 123, respectively, of the dead-front member 120.

Two parallel cord clamp teeth 170 and 171 are diagonally disposed between two blocks 172 and 173, the blocks 172 and 173 being integral with both the wall 163 and front panel 161 of side cover 160. The cord clamp teeth 170 and 171 are oppositely diagonally disposed to the cord clamp teeth 150 and 151 of side cover 140 such that the two sets of cord clamp teeth crisscross when dead-front electrical plug 100 is assembled. Two openings 174 and 175 are formed in the blocks 172 and 173 respectively, and the openings 174 and 175 are countersunk into the outside surface of front panel 161, as best seen in FIG. 8. Two additional openings 176 and 177 are formed in the blocks 172 and 173, respectively, adjacent to the legs of the U-shaped wall 163. The front panel 161 defines an additional two openings 178 and 179 which receive the dowel pins 132 and 133 when the electrical dead-front plug 100 is assembled.

The dead-front electrical plug 100 is assembled by first connecting the wire conductors 114 – 116 of cord 113 to the power blades 102 and 103 and the ground pin 104 via the terminal screws 105 – 107. The wiring connections are easily made with the dead-front electrical plug 100 in the open condition shown in FIG. 8.

Figure 10:
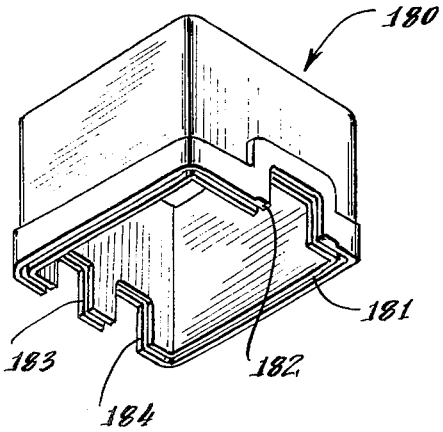
FIG. 10 is a perspective view of a sealing compound barrier for the electrical plug connector of FIG. 7.

An optional, generally rectangular sealing compound barrier sleeve 180, shown in FIG. 10, is fitted over and surrounds the upper ends of the power blades, ground pin, and the wiring connections thereto. The sealing compound barrier sleeve has a groove 181 formed in its lower edge, and the groove 181 receives the circumferential flange 135 of the dead-front member 120. The inside edge of the sealing compound barrier sleeve 180 is received in groove 136 adjacent to flange 135. The lower edge of the sealing compound barrier sleeve 180 is notched at 182, 183 and 184, and notch 182 fits over the more closely spaced dowel pins 130 and 131. The notches 183 and 184 fit over the other more widely spaced dowel pins 132 and 133. A sealing compound (not shown) is placed in the sealing compound barrier sleeve 180, and in this regard it should be noted that the sealing lips such as sealing lip 128 in the opening 125 for power blade 102, prevent any sealing compound from leaking through the dead-front member 120 around the power blades or ground pin.

The side covers 140 and 160 are pivoted together about the web hinges 110 and 111. It will be noted that the side covers 140 and 160 are similarly shaped and fit together to form a smooth exterior of the dead-front electrical plug 100. In particular, the flange 145 and shoulder 146 of side cover 140 interlock with the flange 165 and shoulder 166 of side cover 160 to provide a relatively dust-proof joint which also protects against the insertion of foreign objects into the wiring area.

The prongs 156 and 157 of side cover 140 are received in the openings 176 and 177, respectively, of side cover 160, and the prongs thereby maintain the side covers in alignment against misaligning forces created as the cord 113 is clamped between the crisscrossed cord clamp teeth 150, 151, 170 and 171. The dowel pins 130 – 133 fit snugly into the openings 158, 159, 178 and 179 in the side covers. This interengagement between the dowel pins and the side covers bears any longitudinal forces exerted between the side covers and dead-front member 120, such as those created in pulling the dead-front electrical plug 100 from an electrical socket outlet, and relieve what would otherwise be a stress on the web hinges 110 – 111. The flanges 148 and 168 fit into the groove 123 in the dead-front member 120, and the flanges 147 and 167 fit into the other groove 122 formed in the dead-front member 120. The interengagement between flanges 147, 148, 167 and 168 and grooves 122 and 123 bears any lateral forces created between the side covers and the dead-front member 120, thus completing full stress protection of the web hinges 110 and 111. The covers are secured together by self-tapping screws 186 and 187 which are inserted through the openings 174 and 175 in side cover 160 and are threaded into the openings 154 and 155 in side cover 140.

Thus, the dead-front electrical plug bodies described above are comprised of a single molded piece to which only power blades need be added, which achieves low construction costs. There are no separable parts which can be lost during wiring, and the open condition of the dead-front electrical plugs allows complete access to the terminal screws and greatly facilitates the making of wiring connections. Only two assembly screws are required, and thus the dead-front electrical plugs are easily assembled without the exercise of any particular skill.

The interlocking members of the dead-front electrical plugs relieve any possible stress on the web hinges, and provide an extremely strong structure which is fully insulated. With the addition of the optional sealing compound barriers and the sealing compound, the dead-front electrical plugs are made fully moisture-proof.

It will be appreciated that certain changes may be made in the electrical dead-front plugs described above without departing from the spirit and scope of this invention, which is limited only by the following claims.

I claim:

1. A dead-front electrical plug comprising:

A. a dead-front member comprising the front of the dead-front electrical plug;

B. at least two conductive blades mounted through and supported by said dead-front member, said blades including means for connecting wire conductors thereto;

C. a first side cover comprising one side and substantially one-half of the ends and top of the dead-front electrical plug in its assembled condition, said first side cover pivotally connected to said dead-front member by a web hinge integral with both said first side cover and said dead-front member, wherein said first side cover is pivotable between an open position affording access to said means for connecting wire conductors to said blades and a closed position partially enclosing said means for connecting wire conductors to said blades;

D. a second side cover comprising another side and substantially the other half of the ends and top of the dead-front electrical plug in its assembled condition, said second side cover pivotally connected to said dead-front member opposite to said first side cover by a web hinge integral with both said second side cover and said dead-front member, wherein said second side cover is pivotable between an open position affording access to said means for connecting wire conductors to said blades and a closed position fully enclosing, together with said first side cover, said means for connecting wire conductors to said blades;

E. means for securing said side covers together to maintain the dead-front plug in its assembled condition fully enclosing said means for connecting wire conductors to said blades;

F. at least one first member laterally protruding from one of said dead-front member or said first side cover near the web hinge connecting them, and at least one opening defined in the other of said dead-front member or said first side cover near the web hinge connecting them for receiving said first laterally protruding member in mating interengagement when the electrical dead-front plug is in its assembled condition, whereby said first laterally protruding member bears longitudinal stress between said first side cover and said dead-front member in at least one longitudinal direction and protects said web hinge from such longitudinal stress; and G. at least one second member laterally protruding from one of said dead-front member or said second side cover near the web hinge connecting them, and at least one opening defined in the other of said dead-front member or said second side cover near the web hinge connecting them for receiving said second laterally protruding member in mating interengagement when said dead-front electrical plug is in its assembled condition, whereby said second laterally protruding member bears longitudinal stress between said second side cover and said dead-front member in at least one longitudinal direction and protects said web hinge from such longitudinal stress.

2. A dead-front electrical plug as defined in claim 1 wherein said at least one first member laterally protruding from one of said dead-front member or said first side cover comprises a first flange integral with and protruding from said first side cover toward said dead-front member when the dead-front electrical plug is in its assembled condition, and said at least one opening in the other of said dead-front member or said first side cover comprises a first notch opening in said dead-front member for matingly receiving said first flange when the dead-front electrical plug is in its assembled condition; and wherein said at least one second member laterally protruding from one of said dead-front member or said second side cover comprises a second flange integral with and protruding from said second side cover toward said dead-front member when the dead-front electrical plug is in its assembled condition, and said at least one opening in the other of said dead-front member or said second side cover comprises a second notch opening in said dead-front member for matingly receiving said second flange when the dead-front electrical plug is in its assembled condition.

3. A dead-front electrical plug as defined in claim 2 wherein said web hinge connecting said dead-front member and said first side cover is formed in two aligned portions flanking said first flange and said first notch opening, and wherein said web hinge connecting said dead-front member and said second side cover is formed in two aligned portions flanking said second flange and said second notch opening.

4. A dead-front electrical plug as defined in claim 1 wherein said at least one first member laterally protruding from one of said dead-front member or said first side cover comprises two first dowel pins laterally protruding from said dead-front member and said at least one opening defined in the other of said dead-front member or said first side cover comprises two openings defined by said first side cover, and wherein said at least one second member laterally protruding from one of said dead-front member or said second side cover comprises two second dowel pins laterally protruding from said dead-front member, and said at least one opening defined in the other of said dead-front member or said second side cover comprises two openings defined in said second side cover.

5. A dead-front electrical plug as defined in claim 1 wherein said dead-front member defines openings adjacent to the ends of said web hinges connecting the first and second side covers thereto, and wherein said first and second side covers each comprise members longitudinally protruding therefrom, which members are matingly received in said openings when the dead-front electrical plug is in its assembled condition and bear lateral stresses between said first and second side covers and said dead-front member, thereby protecting said web hinges from such lateral stresses.

6. A dead-front electrical plug as defined in said claim 5 wherein said openings comprise two grooves defined by said dead-front member, each groove extending between and generally perpendicular to said web hinges.

7. A dead-front electrical plug as defined in claim 1 wherein said first and second side covers each comprise mating flanges and shoulders extending about the edges thereof which come together when the dead-front electrical plug is in its assembled condition to fully enclose said means for connecting wire conductors to said blades, said mating flanges and shoulders overlapping to inhibit entry of dust or other foreign objects.

8. A dead-front electrical plug as defined in claim 1 and further comprising:

H. a sealing compound barrier sleeve, said sealing compound barrier sleeve 1. adapted to fit against said dead-front member in sealing engagement therewith,
2. extending away from said dead-front member and surrounding said means for connecting wire conductors to said blades, and
3. enclosed by said first and second side covers when the dead-front electrical plug is in its assembled condition, wherein said sealing compound barrier sleeve is adapted to be filled with a sealing compound for moisture proofing wiring connections to said means for connecting wire conductors to said blades.

9. A dead-front electrical plug as defined in claim 8 wherein said dead-front member defines a groove surrounding said at least two conductive blades mounted through and supported by said dead-front member, and wherein said groove receives a portion of said sealing compound barrier sleeve to achieve sealing engagement between said dead-front member and said sealing compound barrier sleeve.

10. A dead-front electrical plug as defined in claim 8 wherein said sealing compound barrier sleeve defines a groove about the edge thereof which fits against said dead-front member, and wherein said dead-front member includes a flange received in sealing engagement in said groove.

11. A dead-front electrical plug as defined in claim 1 and further comprising:

H. an insulation barrier integral with and extending upwardly from said dead-front member between said at least two conductive blades.

12. A dead-front electrical plug as defined in claim 1 wherein said first and second side covers each define a semi-circular opening, said semi-circular openings cooperating to accommodate passage of a cord into the dead-front electrical plug in its assembled condition; and wherein said first and second side covers each comprises integral upstanding cord clamp teeth adjacent to said semi-circular opening, said cord clamp teeth cooperating to grip said cord; and wherein one of said first or second side covers comprises two prongs flanking said cord clamp teeth and the other of said first or second side covers define openings flanking said cord clamp teeth for receiving said prongs.

13. A dead-front electrical plug as defined in claim 1 wherein each of said at least two conductive blades comprises an outwardly protruding barb which engages with said dead-front member to maintain said conductive blades securely mounted thereto.

14. A dead-front electrical plug having a longitudinal axis comprising:

a dead-front member of electrical insulating material having a front end which includes an exterior portion substantially perpendicular to the longitudinal axis and an interior portion;

at least two electrically conductive blades having blade ends for connection to electrical conductors;

support means on said interior portion of said member for mounting said blade ends with parts of said blades extending through said member and from said exterior portion substantially parallel to said axis;

a plurality of covers, each having frontward and rearward ends;

web hinge means formed integral with the frontward cover ends and said front end of said member for allowing pivotal movement of said covers about axes substantially perpendicular to the longitudinal plug axis, whereby the covers are movable from an open position affording access to said interior portion of said member to a closed position wherein the covers at least partially enclose said interior portion and a length of the electrical conductors connected to said blade ends;

first means formed by frontward end portions of the covers and front end portions of said member for matingly engaging along the plug axis when said covers are in the closed position to resist forces at substantially right angles to said axis;

second means formed by parts of the interior portion of said member and mating portions of the covers for engaging substantially perpendicularly to said axis when said covers are in a closed position to resist forces substantially parallel to said axis; and third means for securing the rearward ends of said covers together to at least partially enclose said length of electrical conductors.

15. The plug as claimed in claim 14 wherein said first means comprises a lug projecting forwardly of each cover substantially parallel to the plug axis for matingly engaging surfaces formed by interior cavities in said front end of said member when each cover is closed.

16. The plug as claimed in claim 14 wherein said second means comprises a plurality of lugs projecting outwardly from the interior portion of said member at substantially right angles to the plug axis for matingly engaging respective surfaces formed by interior cavities in each of the frontward cover ends.

17. The plug as claimed in claim 15 wherein said third means comprises two threaded fasteners extending through one of said covers at substantially right angles to the plug axis and threadly engaging the other of said covers, said fasteners passing to each side of the conductors.

18. The plug as claimed in claim 17 and further comprising, means formed on both of said covers proximate the rearward ends thereof for gripping the conductors therebetween when said fasteners are tightened.

19. The plug as claimed in claim 16 which further comprises fourth means formed by said covers adjacent the rearward ends thereof for matingly interengaging in directions substantially perpendicular to the plug axis when said covers are in a closed position to prevent axial displacements between said covers.

20. A dead-front electrical plug having a longitudinal axis comprising, a dead-front member of electrical insulating material having a front end which includes an exterior portion, and an interior portion;

at least two electrically conductive blades having blade ends for connection to electrical conductors;

means on interior portion for mounting said blade ends with parts of said blades extending through said member and from said exterior portion substantially parallel to said axis;

a plurality of covers, each having frontward and rearward ends;

web hinge means integral with the frontward cover ends and said front end of said member for allowing opening and closing of said covers relative to the longitudinal plug axis, whereby the covers are movable from an open position affording access to said interior portion of said member to a closed position where the covers at least partially enclose said interior portion and a length of the electrical conductors connected to said blade ends;

locking means exclusive of said web hinge means for locking the frontward ends of said covers to said dead-front member when said covers are in the closed position; and means for securing the rearward ends of said covers together to at least partially enclose said length of electrical conductors.

21. A dead-front electrical plug according to claim 20 wherein said locking means comprises locking means integral with the dead-front member and covers for locking said covers to said dead-front member.

* * * * *